US005099626A

United States Patent [19]

Seeger

[11] Patent Number: 5,099,626

[45] Date of Patent: Mar. 31, 1992

[54] CONNECTION FOR TUBULAR MUNTIN BARS

[75] Inventor: Robert Seeger, Barrington, Ill.

[73] Assignee: Allmetal Inc., Bensenville, Ill.

[21] Appl. No.: 612,785

[22] Filed: Nov. 14, 1990

[51] Int. Cl.[5] ..... E04C 2/38

[52] U.S. Cl. ..... 52/314; 52/656; 52/790

[58] Field of Search ..... 403/255, 254, 187, 298; 52/656, 314, 584, 788, 790, 456, 304

[56] References Cited

U.S. PATENT DOCUMENTS 4,783,938 11/1988 Palmer .
4,856,243 8/1989 Ault et al. ..... 52/304
4,970,840 11/1990 Ouellette et al. ..... 52/311
4,989,384 2/1991 Kinghorn et al. ..... 52/456

FOREIGN PATENT DOCUMENTS 2637034 2/1978 Fed. Rep. of Germany .

*Primary Examiner*—David A. Scherbel
*Assistant Examiner*—Robert Canfield
*Attorney, Agent, or Firm*—Allegretti & Witcoff, Ltd.

[57] ABSTRACT

A unitary connector for connecting hollow muntin bars transversely includes one end with barbed projections or hooks which engage openings in the planar sides of the tubular muntin bars and which also include an opposed plug which engages the hollow open end of a muntin bar. The connector includes laterally extending tabs to engage opposed panes of glass.

11 Claims, 1 Drawing Sheet

Fig.1
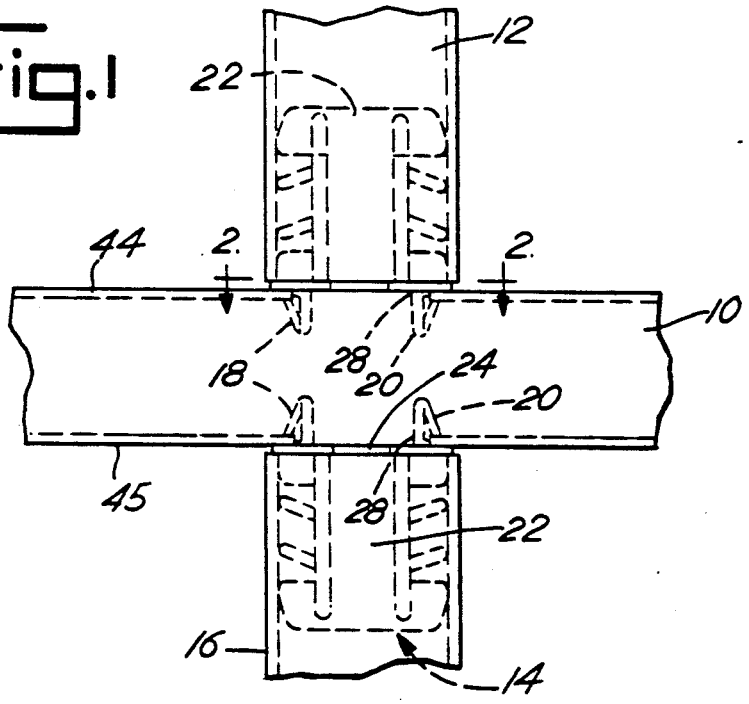
Fig.2
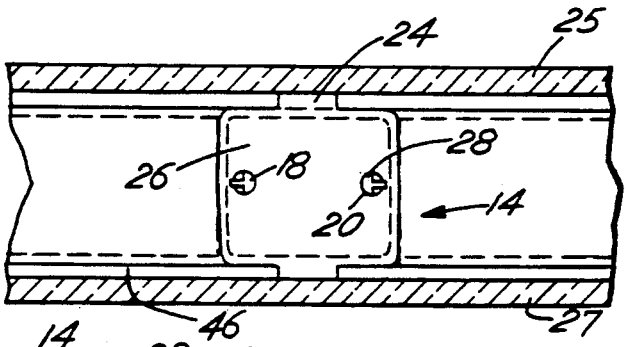
Fig.3
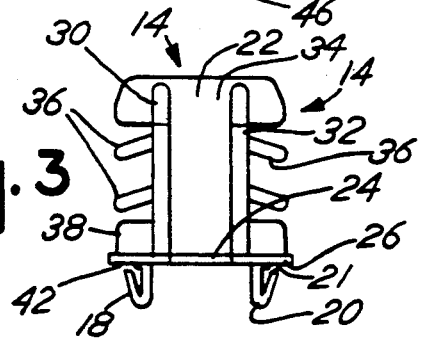
Fig.5
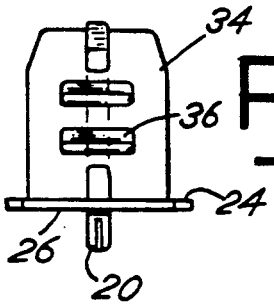
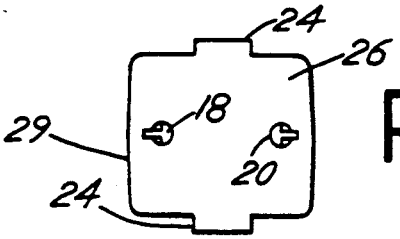
Fig.4

CONNECTION FOR TUBULAR MUNTIN BARS

BACKGROUND OF THE INVENTION

To provide a double glazed window with the appearance of a tranditional divided lite window having smaller panes separated by conventional muntin bars, it is customary to provide intersecting muntin bars between the panes of glass. To permit air between the panes to circulate over the muntin bar dividers, spacers called bumper buttons are adhered to the outer faces of the muntin bars or to cruciform connections joining the bars. Providing these buttons and assembling them during the production of the window adds cost to the product.

The internal muntin bars are usually assembled in a cruciform design, one bar intersecting another at right angles. To accommodate windows of varying size, tubular muntin bars are cut to the desired length and assembled with a plastic cruciform connector having four plugs disposed at 90° to each other, which slide into the open ends of tubular muntin bars. The bars are uniform and generally rectangular in cross section. The design is modular, it being necessary only to cut the bars to length and assemble them with the plastic cruciform connector. One of the problems in using plastic connectors is that gases and particulate matter evolve from the plastic material forming the cruciform connector at the high temperatures that prevail between the glass panes when exposed to sun light. These materials, such as polyethylene, polypropylene and some nylon compositions, may fog the glass, especially if the area enclosed by the muntin bars forming one lite does not permit air circulation within the entire space between the panes. Materials emitted by the connectors may include wax products, light oils, silicones and other materials present in the manufacturing process of the connectors.

THE INVENTION

The object of this invention is to provide a unitary connector which serves to interconnect intersecting tubular muntin bars and simultaneously provide a spacer to support the panes of glass above the plane of the internal muntin bars. Thus separate button spacers required by the prior art are completely eliminated. Another object is to provide a connector which joins an open end of a tubular muntin bar with the side wall of an intersecting muntin bar. The connector of the invention is molded from substantially less volume of plastic material and consequently reduces proportionately the gaseous or particulate material that can evolve. The connector may be used to assemble cruciform muntin bars without any tools since it frictionally engages the end of one tubular muntin bar with openings in the side wall of the intersecting muntin bar. In a preferred form of the invention the connector has hooks that slide through openings in the wall of a bar and lock against pulling out to insure a tight connection. By providing a single connector which also functions as a spacer, the cost of separate spacers and the labor to assemble and stock them is reduced or eliminated.

Thus an object of the invention is to provide an improved connector for muntin bars.

Another the object is to provide an improved connector of reduced volume relative to prior art connectors.

Another object is to provide a connector which also serves as a means for spacing the muntin bars from a pane of glass.

THE DRAWINGS

These and other objects and advantages of the invention will become apparent from the following description when read in conjunction with the accompanying drawings in which;

FIG. 1 is a plan view of a cruciform of two intersecting tubular muntin bars interconnected by means of the connectors of the invention;

FIG. 2 is a sectional view taken along the line to 2—2 FIG. 1 and which shows the bars disposed between panes of glass;

FIG. 3 is a front elevational view of the connector of the invention;

FIG. 4 is an end elevational view of the connector shown in FIG. 3; and

FIG. 5 is a side elevational view of the connector shown in FIG.3.

DETAILED DESCRIPTION OF THE PREFERRED EMBODIMENT

As shown in FIGS. 1 and 2, a tubular muntin bar 10 is interconnected with an intersecting tubular muntin bar 12, 16. The bars are preferably formed from aluminum. The cruciform is disposed between two panes of glass which are mounted in parallel relation in a frame, not shown. The connector indicated generally at 14 has an intermediate plate or rectangular disk 26. A reticulated plug 22 extends from the inner face of the plate 26 and a pair of hooks 18, 20 project from the outer face of the plate 26. Tabs 24 project from the top and bottom edges of the plate 26 to provide spacers for the panes of glass 25, 27 which are mounted adjacent the internal muntin bars. The linear dimensions of the rectangular plate 26 are slightly larger than the internal dimensions of the hollow, generally rectangular cross section tubular muntin bar 12, 16. The plate 26 is disposed between the cut end of bars 12, 16 and the side walls of bar 10. The edges of the plate 26 should be coincident with the outer surfaces of the walls of the tubes 12, 16. Only the tabs 24 project above the surface of the tubular muntin bars. The connector is integrally molded from a thermoplastic material such as modified type 6 nylon.

Referring to FIG. 3–5 the reticulated plug 22 of connector 14 consists of a pair of spaced flanges 30, 32 projecting at right angles from the plane of the plate 26. A central H-shaped rib 34 extends between the flanges 30, 32 and has a front and rear cross member 38, 34. The front cross member 38 connects integrally with the inner face of plate 26. Lateral ribs 36 project from the flanges 30, 32. It will be noted that these lateral ribs are inclined toward the plate 26. The lateral edges of the rear cross member 34 are tapered away from the plate 26. This design facilitates insertion of the reticulated plug 22 into the end of the hollow tubes 12, 16. The lateral edges of the cross members 34 and 38 and of the lateral ribs 36 bear against the inside surfaces of the wall to hold the connector firmly inside the tube.

A pair of hooks 18, 20 are provided on the outer face of the plate 26. The hooks are V-shaped and because they are molded from a resilient plastic material, the free ends 21 of the hooks will flex inwardly to permit the hooks to pass through openings 28 in the side walls of the tubular muntin bar 10. The distance 42 between the free end 21 of the hook and the outer surface of the plate 26, is approximately equal to the thickness of the side walls 44, 45. Thus when the hooks are pushed through the openings, the free ends spring out and bear against the surface of the side wall to lock the connector in place.

As shown in FIG. 2 the tabs 24 provide a space 46 between the surfaces of the muntin tubes and the inner face of the glass panes 25, 27. Thus air and any gaseous particulate or material which may evolve from the plastic is not confined within a single lite bounded by the muntin bars but may circulate freely throughout the entire area within the window frame. In the preferred embodiment, the connector 14 is made from a modified type 6 nylon material.

By providing connectors which join one end of a tubular muntin bar with the side wall of an intersecting muntin bar the size of the connector is reduced by about one half. This in contrast to the prior art connector of cruciform design which had four plugs each fitting into one end of the intersecting tubular muntin bars. Thus the amount of volatile material emitted of evolved from plastic at elevated temperatures is significantly reduced.

With the present invention, a single connector may be used for all joints. That is the connector disclosed may be used in lieu of a cruciform connection, to connect muntins at a T-connection and even to form a corner. Also, it should be noted that the connector 14 may include tabs 24 only on one side thereof thereby enabling construction of a double pane window having one pane abutting the muntin bar and the second pane spaced from the bar to permit circulation.

While a preferred embodiment has been described, various alternative embodiments may be utilized within the scope of the invention which is limited only by the following claims and their equivalents.

What is claimed is:

1. A window assembly comprising in combination:

a pair of spaced panes of glass mounted in a frame;

a first tubular muntin bar of rectangular cross section and having one open end, said first muntin bar disposed between said glass panes;

a second tubular muntin bar having a pair of openings through one wall thereof disposed between said panes at a right angle to said first tubular muntin bar with said openings facing said one open end;

a plastic connector for joining said first and second muntin bars said connector comprising, a flat plate, the periphery of which is slightly larger than the inside dimensions of said first tubular muntin bar, said plate having an inner face and an outer face;

a reticulated plug extending from said inner face and frictionally engaged with the interior of said first tubular muntin bar;

a hook projecting from said outer face and extending through said opening in said second muntin bar to thereby join the bars; and first and second unitary tabs extending respectively from opposed edges of said plate above the plane of the walls of said muntin bars to engage and thereby space the glass panes from the adjacent surfaces of said walls.

2. An integrally molded plastic connector for connecting a first hollow, tubular muntin bar and a second hollow tubular muntin bar, said first muntin bar having an open end, said second muntin bar having a side wall with a pair of openings in said side wall through to the hollow interior of the second muntin bar, said connector comprising in combination:

a flat plate having an inner face and an outer face;

reticulated plug means on said inner face which frictionally fit within the open end of said first muntin bar;

a pair of hooks projecting from said outer face which hooks fit into said openings through the side wall of said second tubular muntin bar; and an integral first tab extending laterally, outwardly above one edge of said plate and in a direction that is transverse to the side wall of the second muntin bar when assembled therewith and defining a projection above a surface defined by the first and second tubular muntin bars to provide means for spacing a window pane from the muntin bars.

3. The connector of claim 2 including a second tab extending outwardly above the edge of said plate opposed to said one edge to provide means for spacing a window pane from the opposite side of first and second joined muntin bars.

4. The connector of claim 2 which is molded from flexible resilient plastic material.

5. The connector of claim 2 in which said reticulated plug means comprises;

a pair of spaced parallel flanges perpendicular to the plane of said plate; opposed edges of which bear against interior surfaces of said first, hollow muntin bar when assembled with said second, hollow muntin bar;

a central rib extending between said parallel flanges; and at least one lateral rib projecting from an exterior face of each of said flanges, outer edges of said ribs bearing against interior surfaces of said first muntin bar when assembled with said second muntin bar.

6. The connector of claim 5 in which said lateral ribs are inclined toward said plate.

7. The connector of claim 6 in which said central rib has a frontal cross member that extends beyond said flanges and joins the inner face of said plate.

8. The connector of claim 7 in which said hooks are aligned with said frontal cross member.

9. The connector of claim 8 in which each said hook has a flexible free end, the terminus of said free end being spaced from said outer face a distance which approximates the thickness of said second muntin bar side wall whereby said free end abuts the interior surface of said side wall when the connector is assembled with said second muntin bar.

10. An integrally molded plastic connector for connecting a first tubular muntin bar with a second tubular muntin bar, said first muntin bar having an open end and the second muntin bar having an opening in a side wall, said concector comprising, in combination;

a flat rectangular plate having an inner face and an outer face;

plug means on said inner face which frictionally fits within said open end of the first muntin bar;

hook means on said outer face which fits into said side wall opening of the second muntin bar; and a first integral tab extending above one edge of said plate;

defining a projection above a surface defined by the intersecting muntin bars to provide means for spacing a window pane from the connected muntin bars.

11. The connector of claim 10 including a second tab extending above the edge of said plate opposed to said one edge to provide means for spacing a window pane from the connected muntin bars.

* * * * *